United States Patent [19]

Marks et al.

[11] Patent Number: 4,776,620

[45] Date of Patent: Oct. 11, 1988

[54] DOOR LATCH FOR DISHWASHER

[75] Inventors: Larry D. Marks; Geoffrey L. Dingler, both of St. Joseph Township, Berrien County, Mich.

[73] Assignee: Whirlpool Corporation, Benton Harbor, Mich.

[21] Appl. No.: 157,117

[22] Filed: Feb. 10, 1988

Related U.S. Application Data

[63] Continuation of Ser. No. 912,279, Sep. 29, 1986, abandoned.

[51] Int. Cl.[4] ..... E05C 19/06

[52] U.S. Cl. ..... 292/228; 292/DIG. 69; 292/254

[58] Field of Search ..... 292/228

[56] References Cited

U.S. PATENT DOCUMENTS

| | | | |
|---|---|---|---|
| 3,229,061 | 1/1966 | Harroff | 200/61.62 |
| 3,684,343 | 8/1972 | Hancock | 200/61.62 |
| 3,841,675 | 10/1974 | Mercer | 292/DIG. 69 X |
| 3,841,677 | 10/1974 | Guth | 292/DIG. 69 X |
| 3,865,097 | 2/1975 | Robinson | 292/DIG. 69 |
| 3,912,891 | 10/1975 | Mercer et al. | 200/61.67 |
| 3,997,201 | 12/1976 | DeSchaaf et al. . | |
| 4,032,180 | 6/1977 | Pohl | 292/DIG. 69 |
| 4,109,950 | 8/1978 | Amdal | 292/254 |
| 4,341,409 | 7/1982 | Sakoda | 292/254 |
| 4,497,513 | 2/1985 | Sasaki | 292/DIG. 69 X |
| 4,509,779 | 4/1985 | Sasaki | 292/DIG. 69 X |
| 4,638,515 | 1/1987 | Caputo et al. | 292/254 X |

*Primary Examiner*—Richard E. Moore

*Attorney, Agent, or Firm*—Wood, Dalton, Phillips, Mason & Rowe

[57] ABSTRACT

According to the invention, a fixed bolt is provided on the door of a dishwashing apparatus and cooperates with a strike plate on a cabinet, against which the door seats in a closed position, to latch the door in the closed position. The strike plate in addition to latching the door, concurrently activates a switch that is fixedly mounted on the door.

14 Claims, 1 Drawing Sheet

DOOR LATCH FOR DISHWASHER

This application is a continuation of application Ser. No. 912,279, filed Sept. 29, 1986, now abandoned.

BACKGROUND OF THE INVENTION

1. Field of the Invention

This invention relates to door latching structure and, more particularly, to structure for concurrently activating an electrical switch.

2. Description of the Prior Art

It is known to provide a door actuated swtich on a dishwashing apparatus, which switch is deactivated and thereby prevents operation of a control mechanism with the door in an open state. An exemplary structure is shown in U.S. Pat. No. 3,229,061, to Harroff. In Harroff, a leaf spring is associated with a depressible actuator button on the door so that upon engagement of the spring by a shaft on the cabinet, as the door is being closed, the actuator button is activated.

Harroff has several inherent drawbacks. First of all the structure is quite complicated. Spring loaded catches are provided to collapse against the shaft with the door in the closed position. An intricately formed leaf spring transmits a force from the shaft to the actautor button to effect activation thereof. As a result of the complicated nature of the Harroff structure, it takes up a substantial amount of space in the door and thus competes for space with the electrical control mechanism for the apparatus.

SUMMARY OF THE INVENTION

The present invention is specifically directed to overcoming the above problems in the prior art structures in a novel and simple manner.

According to the invention, a fixed bolt is provided on the door of a dishwashing apparatus and cooperates with a strike plate on a cabinet, against which the door seats in a closed position, to latch the door in the closed position. The strike plate, in additiion to latching the door, concurrently activates a switch, which is fixedly mounted on the door.

In a preferred form, the strike plate is deformable and is deflected by the bolt as the door is being closed and, upon the door closed position being realized, reassumes its undeflected state wherein it latches the door and activates the switch. Consequently, the structure is simple and will positively prohibit operation of the dishwashing apparatus until the door is latched. Additionally, the simplified nature of the inventive structure gives it potentially a very low profile, thereby leaving space in the door for other structure.

DETAILED DESCRIPTION OF THE DRAWINGS

Figure 1:
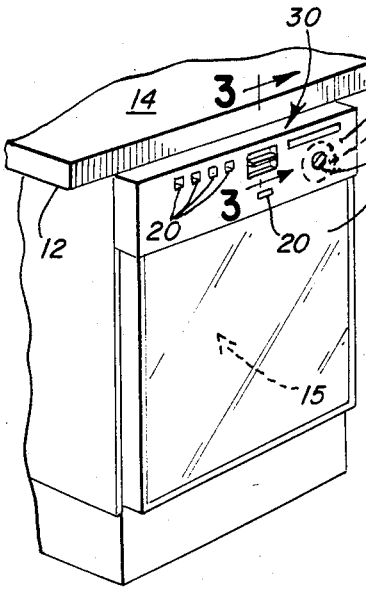
FIG. 1 is a perspctive view of a dishwashing apparatus incorporating door latching structure according to the present invention.

In FIG. 1, a dishwashing apparatus suitable for the incorporation of the present invention, is shown at 10. The apparatus in FIG. 1 is an under-the-counter design and is floor mounted so that the top of the apparatus 10 resides closely beneath the underside 12 of a counter 14. A wash chamber at 15 accepts a plurality of racks (not shown) for supporting dishes and utensils. The wash chamber 15 has an access opening at its front which opening is selectively closed by a hinged door 16, shown in FIG. 1 in its closed position. The door 16 has an associated console 18 which houses the control mechanism for the dishwashing apparatus and supports operator controls 20 and a manually operable cycling knob 2 for an electrical timer mechanism 23.

Figure 2:
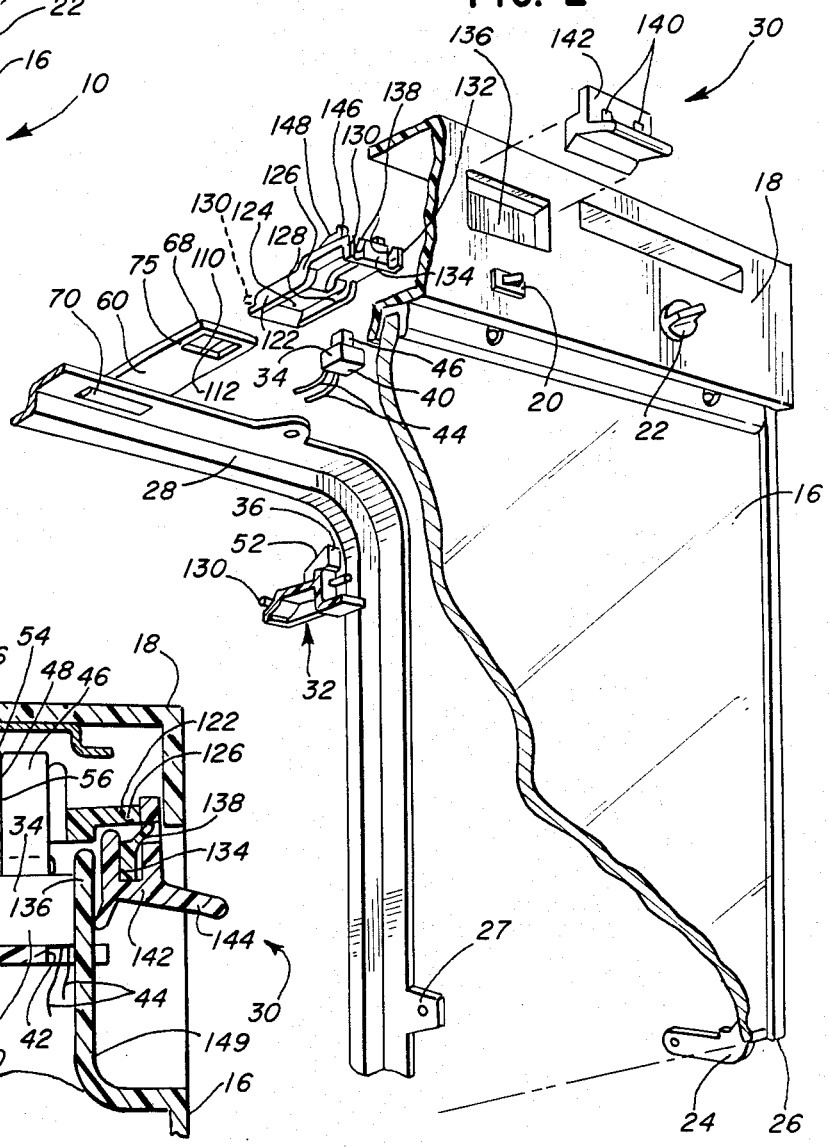
FIG. 2 is an exploded perspective view of the door of FIG. 1 and associated latching structure.
Figure 3:
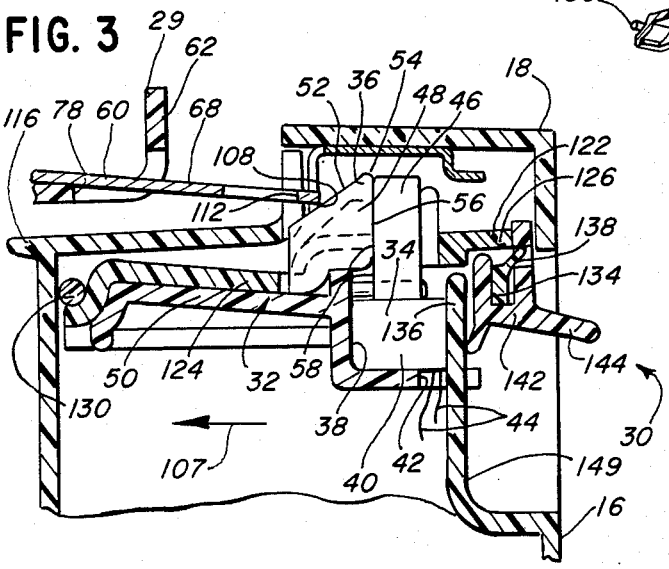
FIG. 3 is a sectional view of the door latching structure along line 3—3 of FIG. 1 with the door moving towards its closed position.

As seen clearly in FIG. 2, the door 16 has laterally spaced hinge portions 24 (one shown) adjacent its bottom edge 26 for making pivotable connection with hinge extensions 27 that are part of a forward horseshoe shaped support frame element 28 that extends peripherally up the sides and over the top of a plastic tub 29 (FIGS. 3 and 4) defining the wash chamber 15. The frame element is preferably made of metal, such as steel. With the door in the closed position of FIG. 1, the door 16 is selectively latched and released by a door latching mechanism at 30, at the upper portion of the door. It is this structure wherein the present invention is embodied. The door latching mechanism is detailed in FIGS. 2-4.

The inside of the door 16 has a frame 32 fixedly secured to the door for supporting a switch 34 and a bolt 36. The frame 32 defines an upwardly opening pocket 38 which closely and fixedly accepts a square body 40 on the switch. The pocket has an opening 42 through which switch leads 44 can be directed. The switch has an actuator button 46 biased normally upwardly from the body to its open state. The switch is activated by depressing the button 46 downwardly from its FIG. 3 position to the FIG. 4 position.

The bolt 36 has an enlarged head 48 extending upwardly from an elongate leg 50 on the frame 32. The head 48 has a ramp surface 52, that is inclined upwardly from the back towards the front of the door, and a curved edge 54 at the upper extremity thereof. At the front of the head 48 is a forwardly facing shoulder surface 56, which resides closely, guidingly against an edge 58 on the actuator 46.

A strike plate 60, preferably made of spring steel, is carried in cantilever fashion by the frame element 28 and projects forwardly of the front edge 62 of the tub 29. The tub 29 has a Z-shaped extension 64, directed upwardly from its upper surface 66 at the forward portion of the tub, with which the strike plate 60 cooperates. The strike plate 60 has a forward latching portion 68, which engages the bolt 36, and a mounting portion 70, which cooperates with the tub and frame 28 to effect mounting thereof on opposite ends of a body portion 75.

Figure 4:
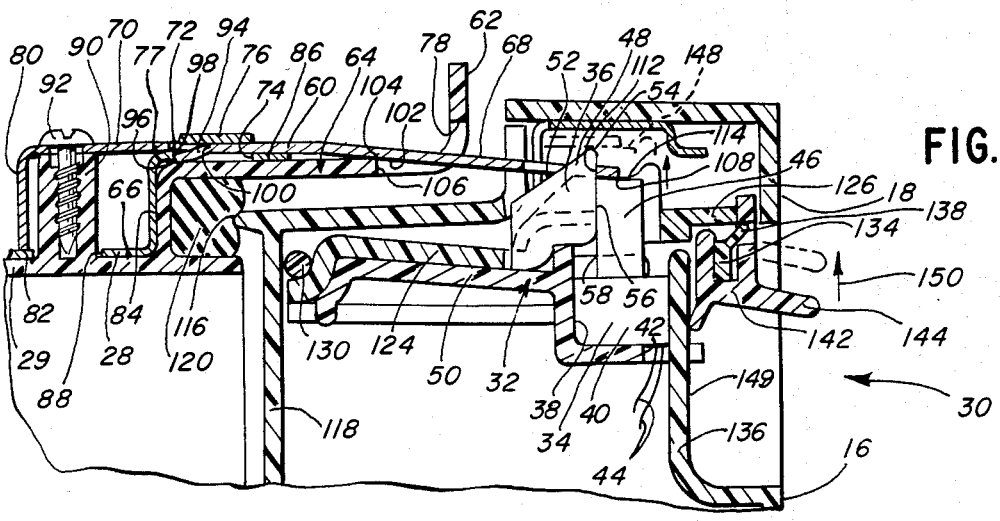
FIG. 4 is a sectional view of the door latching strucutre with the door in its closed and latched position.

The frame element 28 has two substantially parallel slots 72, 74 cut therein that are substantially equal in length to the width of the body 75 of the strike plate 60. The slots permit the bending out of a frame section 76 as shown in FIG. 4 so that a space is defined between the section 76 and the upper frame surface 77. To effect assembly of the strike plate, the body 75 is directed forwardly under the frame section 76 and is therefore confined by the section 76 against movement vertically away from the tub. The body 75 extends through a cut-out 78 on the tub extension 64. At its rearward portion, the strike plate has an offset leg 80 with a free edge 82 that bears against the frame element 28.

The frame element 28 has a stepped cross section to closely conform to the upper surface 66 of the tub, a rearwardly facing surface 84 on the extension 64 and an upwardly facing surface 86 on the extension. The frame element has a cut-out 88 to accommodate an anchoring lug 90 integrally formed with the tub. The rear portion of the strike plate is fastened to the anchoring lug 90 by a screw 92.

To block rearward shifting of the strike plate as the door is closed, a tab 94 is provided on the plate 60 and is bent out of the plane of the body 75 to define a rearwardly facing edge 96 which abuts a forwardly facing edge 98 defined by the bending out of the frame section 76 to form a cut-out 100 on the frame element. During assembly of the strike plate, the tab 94 will deflect sufficiently to allow forward movement thereof relative to the frame element 28 until the edge 96 encounters the cut-out 100, at which point the tab will deform downwardly as shown in FIG. 4 to present the edges 94, 96 interferingly against each other.

The tub cut-out 78 gives the latching portion of the strike plate room to deflect vertically. In its relaxed state, the latching portion 68 of the strike plate is bent slightly downwardly and the underside 102 thereof abuts a corner 104 on an edge 106 bounding the cut-out 78. As the door is moved to its closed position in the direction of arrow 107 in FIG. 3, a forward edge or corner 108 at the free end of the strike plate encounters the ramp surface 52 and progressively deflects the latching portion 68 of the strike plate upwardly. The frame element 28 has some inherent flexibility and resistently twists slightly as the plate moves against the bolt. Upon the door realizing the closed position, the bolt 36 projects through a rectangular cut-out 110 on the strike plate and allows the latching portion 68 of the strike plate to reassume its undeflected state and move downwardly into the position shown in FIG. 4, which represents the latched position of the door.

In the latched position, a rearwardly facing latching edge 112 of the strike plate bounding the cut-out 110 seats behind the shoulder surface 56 and prohibits opening of the door. At the same time, the corner 108 of the strike plate bears dirctly against an upper surface 114 of the actuating button so as to activate the same. It can be seen that the actuator button will be activated upon the door being properly latched. In the latched position, a rearwardly facing edge 116 on an inner door liner 118 on the inside of the door is urged compressively against a resilent seal 120 about the access opening.

To release the door from its latched state, a pivotable release element 122 is provided. The release element 122 comprises a flat body 124, which facially abuts the leg 50 on the frame 32 with the release element in its normal position. As the sides of the body 124 are two elongate, spaced, parallel legs 126, 128. At the rear portion of the legs 126, 128 laterally projecting pins 130 are provided for guiding pivoting movement of the release element 122. The forward portion of each leg 126, 128 has an offset 130, 132 respectively and the offsets are interconnected by a flat portion 134. The flat portion 134 and offsets 130, 132 depend from the legs 126, 128 forwardly of a recessed wall 136 at the front of the door, which wall bounds one edge of the switch pocket 38. The flat portion 134 has lugs 138 which allow snap-fit connection in openings 140 in an operating handle 142 having an associated ledge 144 situated to be easily grasped by an operator.

Each of the legs has a mid-length projction 146 with an upper cam surface 148 which can be brought into engagement with the underside surface 102 of the strike plate 60. By grasping the handle 142 and drawing the same upwardly in the recess 149 in the direction of arrow 150 in FIG. 4, the release element 122 progressively biasably urges the latching portion 68 of the strike plate upwardly until it clears the curved edge 54 of the bolt 36. At the same time actuator 46 is released to its upward open state. The door can then be pivoted to its open position.

It can be seen that the entire door latch assembly has a very low profile and that the strike plate serves the dual purpose of latching to the bolt and depressing the actuator. Space need only be provided to accommodate pivoting of the release element and the following strike plate.

The foregoing disclosure of specific embodiments is intended to be illustrative of the broad concepts comprehended by the invention.

We claim:

1. In an appliance controlled by an electrical timer mechanism and having a tub defining a wash chamber, a housing extending about said tub and having an opening therein through which access can be gained to said tub wash chamber, and a door in the housing selectively movable between an open position and a closed position wherein the door closes said opening, improved structure for releasably latching the door in the closed position and permitting operation of the timer mechanism only when the door is latched in said closed position, said structure comprising:

a switch having a body;

an actuator;

means for mounting the actuator relative to the body selectively in (a) a first position wherein operation of the timer mechanism is prevented and (b) a second position wherein the timer mechanism may be operated;

means biasing the switch actuator into said first position;

means mounting the switch body in a substantially fixed position on the door;

a bolt having a shoulder;

means mounting the bolt in a substantially fixed position on the door so that the bolt shoulder faces in a first direction with the door in the closed position;

a strike plate comprising a flat, spring member having oppositely facing, substantially parallel flat surfaces, spaced ends, and an opening therein adjacent one of said spaced ends, said strike plate defining a latching edge of said opening facing in a second direction oppositely to said first direction; and means mounting the other of said spaced ends of the strike plate on the housing in cantilever fashion so that said one of said spaced ends is springable transversely to the flatwise extent of said oppositely facing flat surfaces of the strike plate and so that upon the door being moved towards its closed position the strike plate is intercepted and said one end is springably deflected in a third direction transversely to the flatwise extent of said oppositely facing flat surfaces by the bolt, and upon said door reaching its closed position said strike plate springs back under a restoring force acting oppositely to said third direction to a substantially undeflected state wherein the bolt is disposed in said plate opening with said edge facing said bolt shoulder to prevent opening of the door, said restoring force further urging the switch actuator from its first position to its second position.

2. The appliance according to claim 1 wherein the actuator mounting means mounts the actuator so that the actuator translates in the direction opposite to said third direction between said first and second positions, the bolt has a ramp surface that engages and progressively deflects a portion of the strike plate in said third direction as the door is being closed and, upon the door realizing its closed position, the strike plate springs back oppositely to said third direction and moves against the actuator and thereby causes the actuator to move to its second position.

3. The appliance according to claim 1 wherein the bolt has a ramp surface, a bolt shoulder is at an end of the ramp surface, and the strike plate comprises a flat piece of deflectable metal and one of said spring member flat surfaces rides along the ramp surface as the door is moved from its open towards its closed position.

4. The appliance according to claim 3 wherein pivotable release means are provided for directly engaging the strike plate and moving the latching edge of the strike plate out of facing relationship with the bolt shoulder to allow opening of the door.

5. The appliance according to claim 4 wherein said release means has cam means which engages one of the oppositely facing flat surfaces on the strike plate for progressively deflecting and urging the one plate end in said third direction as the release means is pivoted.

6. In an appliance controlled by an electrical timer mechanism and having a tub defining a wash chamber, a housing with a front and rear, an opening in said tub through which access can be gained to the wash chamber and a door selectively movable between an open position and a closed position wherein the door seals the opening, improved structure for releasably latching the door in the closed position and permitting operation of the timer mechanism only with the door latched in the closed position comprising:

a switch having a body;

an actuator;

means mounting the actuator for movement relative to the body between (a) a first position and (b) a second position;

means for preventing operation of the timer mechanism with the switch actuator in a first position and for permitting operation of the timer mechanism with the switch actuator in the second position;

means biasing the switch actuator into the first position;

means mounting the switch body in a substantially fixed position on the door;

a bolt having a shoulder;

means mounting the bolt in a substantially fixed position on the door so the bolt shoulder faces in a forward direction with said door closed;

a strike plate comprising a flat spring member having upwardly and downwardly facing, substantially parallel flat surfaces, spaced ends, and an opening therethrough adjacent one of said spaced ends and bounded by a forwardly facing latching edge; and means mounting the other of said spaced strike plate ends fixedly on the appliance housing in cantilever fashion so that said one of said spaced strike plate ends is deflectable vertically and so that upon the door being moved towards said closed position the strike plate encounters the bolt and the one strike plate end is springably deflected upwardly to allow the door to move to said closed position, and upon said door realizing its closed position the one strike plate end springs downwardly to an undeflected position and the bolt moves into the strike plate opening so that the bolt shoulder and strike plate latching edge are in facing relationship so as to prohibit opening of the door and concurrently said strike plate moves said actuator against the biasing means from the first position into said second position.

7. The appliance according to claim 6 wherein pivoting release means are provided for acting directly against and deflecting the strike plate vertically from its undeflected position with the door in its closed position to allow the latch to be released and the door to be opened.

8. The appliance according to claim 6 wherein the one of the flat strike plate surfaces bears directly against and moves the actuator between the first and second actuator position as the door realizes its closed position.

9. The appliance according to claim 6 wherein the frame to which the strike plate is mounted is deformable and the frame deforms as the door is moved to its closed position to allow vertical movement of the one strike plate end.

10. The appliance according to claim 7 wherein the strike plate has a free end and the release means comprises a lever pivotably mounted to the door, said lever upon being pivoted in an opening direction deflecting the free end of the strike plate in the first direction to disengage the strike plate and bolt.

11. The appliance according to claim 6 including release means for moving the one strike plate end vertically out of its undeflected position to permit opening of the door, said release means comprising a lever and means pivotally connect the lever to the appliance housing for movement between a door closed position and a door release position.

12. The appliance according to claim 11 wherein said lever has spaced cam sufaces to engage the downwardly facing flat strike plate surface.

13. The appliance according to claim 11 wherein said lever has an opening therethrough and said bolt resides within said lever opening with the lever in said door closed position.

14. The appliance according to claim 13 wherein said lever has spaced legs between which the bolt resides with the door in its closed position and each of said lever legs has a cam surface to engage downwardly facing surface portions of the strike plate and move the one strike plate end upwardly as the lever is pivoted from the door closed position to the door release position.

* * * * *